US010105751B2

(12) United States Patent
Lesperance

(10) Patent No.: US 10,105,751 B2
(45) Date of Patent: Oct. 23, 2018

(54) RIVET DISPENSER AND METHOD FOR LOADING RIVETS INTO HANDHELD RIVET GUN

(71) Applicant: HONEYWELL FEDERAL MANUFACTURING & TECHNOLOGIES, LLC, Kansas City, MO (US)

(72) Inventor: Joseph Larry Lesperance, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 285 days.

(21) Appl. No.: 14/965,621

(22) Filed: Dec. 10, 2015

(65) Prior Publication Data

US 2017/0165740 A1 Jun. 15, 2017

(51) Int. Cl.

| | |
|---|---|
| ***B21J 15/38*** | (2006.01) |
| ***B21J 15/10*** | (2006.01) |
| ***B21J 15/04*** | (2006.01) |
| ***B21J 15/32*** | (2006.01) |

(52) U.S. Cl.

CPC ..... *B21J 15/38* (2013.01); *B21J 15/043* (2013.01); *B21J 15/105* (2013.01); *B21J 15/32* (2013.01)

(58) Field of Classification Search

CPC ..... B21J 15/38; B21J 15/105

See application file for complete search history.

(56) References Cited

U.S. PATENT DOCUMENTS

| | | | | |
|---|---|---|---|---|
| 1,482,275 | A | 6/1922 | Stimpson | |
| 3,545,606 | A | 12/1970 | Bennett et al. | |
| 4,033,456 | A | 7/1977 | Wion et al. | |
| 4,592,136 | A | 6/1986 | Hirsch | |
| 4,744,238 | A * | 5/1988 | Halbert | B21J 15/32 227/107 |
| 5,244,088 | A | 9/1993 | Musil | |
| 5,452,796 | A | 9/1995 | Ohuchi | |
| 6,029,814 | A | 2/2000 | Ohuchi | |
| 7,654,389 | B2 | 2/2010 | Vogrig et al. | |
| 2014/0175114 | A1 | 6/2014 | Southgate | |

FOREIGN PATENT DOCUMENTS

| | | |
|---|---|---|
| CN | 201030414 | 3/2008 |

* cited by examiner

*Primary Examiner* — John C Hong
(74) *Attorney, Agent, or Firm* — Hovey Williams LLP

(57) ABSTRACT

A rivet dispenser and method for manually loading a handheld rivet gun. The handheld rivet gun may include an attachment port, and the rivet dispenser may have a unitary, single-piece tool body having channels formed therein, sized and shaped to retain heads of a plurality of rivets. The method may include grasping the rivet dispenser in a first hand, grasping the rivet gun in a second hand, and inserting an end of one rivet, extending outward from the rivet dispenser, into the attachment port, thus attaching the rivet to the handheld rivet gun. The method may then include sliding the one rivet through and out of the channel of the rivet dispenser, via movement of the rivet gun and/or the rivet dispenser. Finally, the method may include actuating the rivet gun to install the one rivet into a hole of a structure or structures to be joined together thereby.

21 Claims, 4 Drawing Sheets

RIVET DISPENSER AND METHOD FOR LOADING RIVETS INTO HANDHELD RIVET GUN

BACKGROUND

Blind rivets, also known as POP® blind rivets, are tubular rivets that are inserted into a hole and clinched by the withdrawal of a central rod or mandrel. Blind rivets are generally used where only one side of the work piece is accessible. When locations requiring rivets are high off the ground, it may be desirable to use portable and light-weight tools, such as manual, single-load rivet guns. An operator in this situation may hold a rivet gun in one hand and a handful of rivets in another. However, this creates a risk of fumbling and dropping rivets while trying to orient and load a rivet into a nose of the rivet gun. Although mechanized loading systems for loading rivets into large stationary machines exist, they tend to be heavy and not suitable for dispensing individual rivets for rivet guns.

SUMMARY OF THE INVENTION

Embodiments of the present invention solve the above-mentioned problems and provide a distinct advance in the art of individual rivet dispensing and loading mechanisms.

Some embodiments of the invention include a method of manually loading a handheld rivet gun. The method may include the steps of grasping a rivet dispenser in a first hand and grasping a handheld rivet gun in a second hand. The rivet gun may include an attachment port and the rivet dispenser may include a unitary, single-piece tool body having channels formed therein, sized and shaped to retain heads of a plurality of rivets. Next, the method may include a step of inserting an end of one of the rivets, extending outward from the rivet dispenser, into the attachment port of the handheld rivet gun, thereby attaching the one rivet to the handheld rivet gun. Then, the method may include a step of removing one rivet from the channel or channels of the rivet dispenser, via movement of the rivet gun and/or the rivet dispenser. Finally, the method may include a step of installing the one rivet into a hole or holes formed into a structure or structures using the handheld rivet gun. The hole or holes may be sized and shaped for receiving the one rivet therein.

In some embodiments of the invention, the tool body of the rivet dispenser may include a handle portion and a rivet-holding portion extending laterally from the handle portion and having channels formed therein, each sized and shaped to retain heads of a plurality of rivets. Furthermore, the step of removing the one rivet from the channel or channels of the rivet dispenser may specifically include sliding the one rivet through one of the channels of the rivet-holding portion until the one rivet is released from the rivet dispenser at an end of the rivet-holding portion opposite the handle portion.

In other embodiments of the invention, the method may additionally include the steps of loading a plurality of rivets into the channels of the rivet dispenser and attaching the tool body to a user's body part or an article of clothing with a lanyard. Additionally or alternatively, the method may also include a step of releasing the first hand's grip on the handle portion of the rivet dispenser, such that the rivet dispenser dangles from the lanyard.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
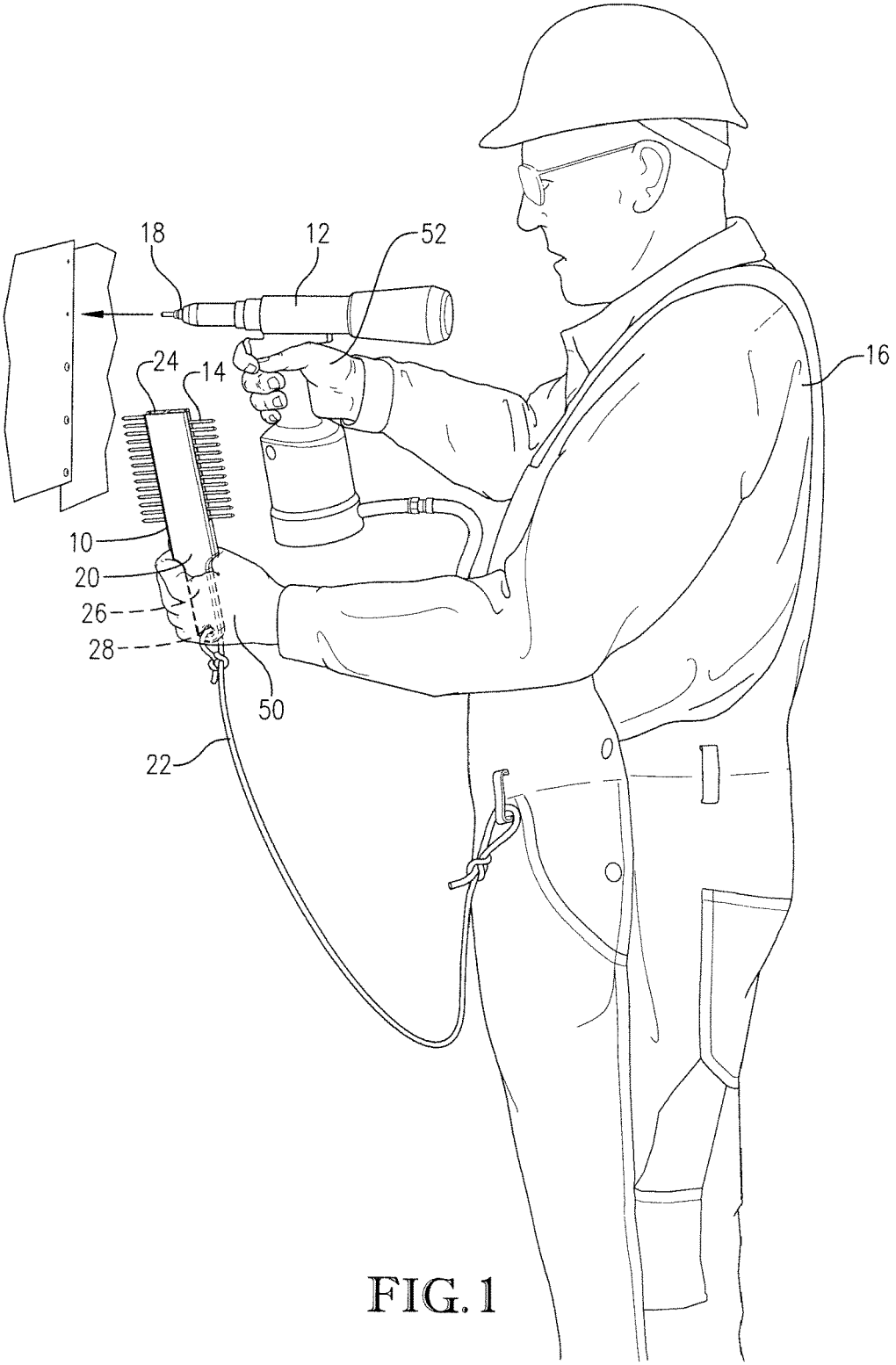
FIG. 1 is an environmental view of a user holding a rivet gun and a rivet dispenser constructed according to embodiments of the present invention.
Figure 2:
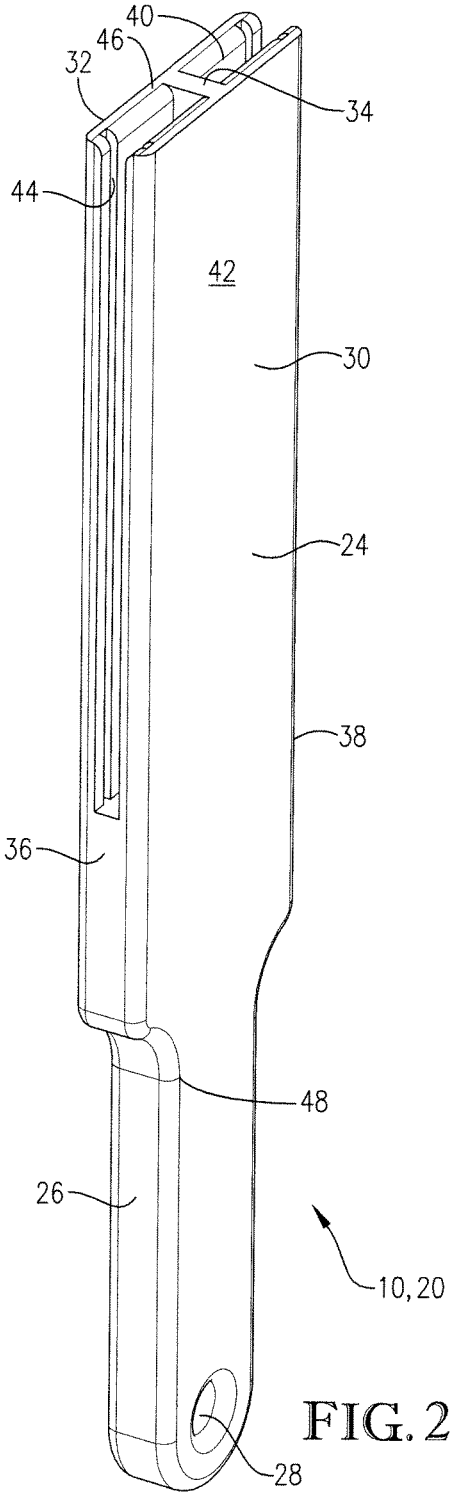
FIG. 2 is a perspective view of the rivet dispenser of FIG. 1.
Figure 3:
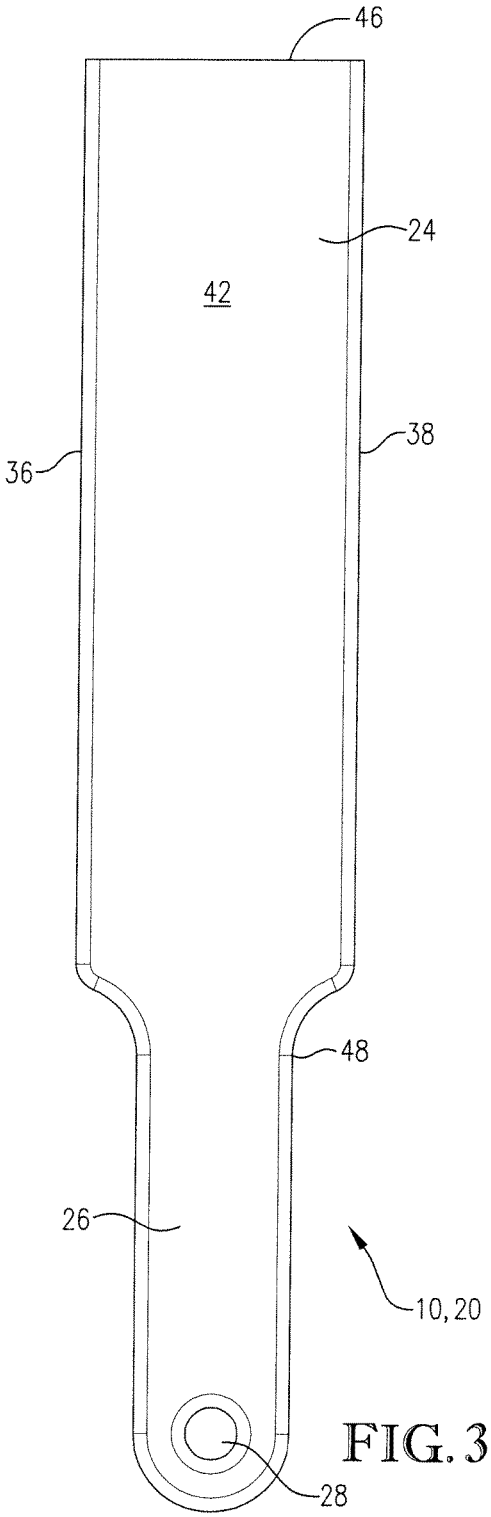
FIG. 3 is a plan view of the rivet dispenser of FIG. 1.
Figure 4:
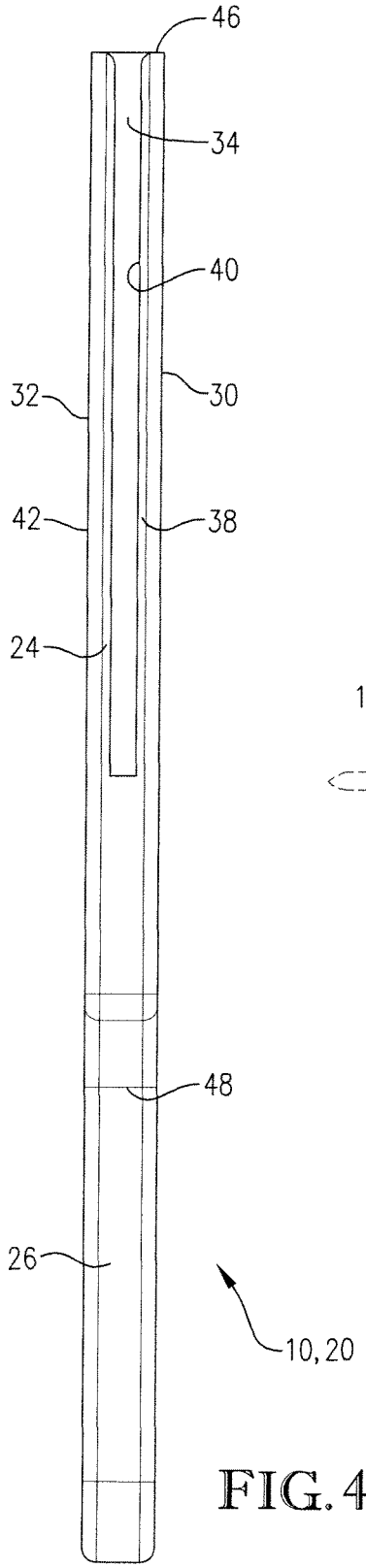
FIG. 4 is a side view of the rivet dispenser of FIG. 1.
Figure 5:
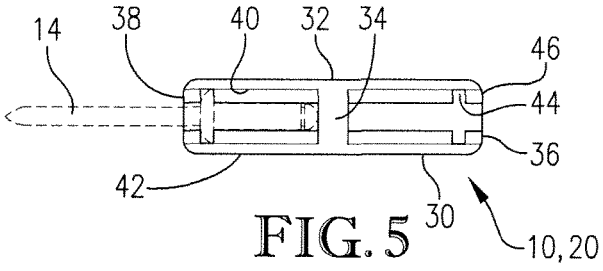
FIG. 5 is an end view of the rivet dispenser of FIG. 1.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Embodiments of the invention include a rivet dispenser 10 and a method of dispensing and loading into a handheld rivet gun 12 one of a plurality of rivets 14 supported in the rivet dispenser 10. As illustrated in FIG. 1, both the rivet dispenser 10 and the handheld rivet gun 12 may each be designed to be held and operated with one hand of a user 16, such that neither is required to be set down by the user 16 during loading of the rivets 14 from the rivet dispenser 10 to the rivet gun 12, as described below.

The rivet 14 may be a mechanical fastener, comprising a short metal pin or bolt, for holding together two plates of metal or other rigid structures. Specifically, before being installed, the rivet 14 may comprise a smooth cylindrical shaft (sometimes called the tail) with a head on one end. When the rivet 14 is placed in a punched or drilled hole, the tail may be bucked or deformed such that it expands to, for example, 1.5 times the original shaft diameter, holding the rivet in place. Specifically, a new "head" is created on an end of the shaft opposite the original head by smashing the tail material flatter, resulting in a rivet that is roughly a dumbbell shape. To distinguish between the two ends of the rivet 14, the original head may be called the factory head and the deformed end may be called the shop head or buck-tail.

More specifically, the rivet 14 may be a blind rivet, also known as a POP® blind rivet, and may be tubular and supplied with a mandrel through a hollow center of the head and/or tail. When the blind rivet is inserted into a hole drilled through the parts to be joined, the rivet gun 12 may be used to draw the mandrel into the rivet, expanding a blind end of the rivet, and then snapping off the mandrel at a break point, sometimes referred to as a blind setting. Unlike solid rivets, blind rivets can be inserted and fully installed in a joint from only one side of a part or structure, blind to the opposite side.

The rivet gun 12 may be any rivet gun configured to force a rivet into one or more structures and/or one or more holes formed therethrough. Specifically, a plurality of structures to be attached to each other may each have at least one hole, the structures may be stacked with these holes aligned, and the structures may be attached together by installation of one of the rivets 14 through the aligned holes via the rivet gun 12. The rivet gun 12 may operate either manually, hydraulically, pneumatically, or otherwise. For example, the rivet gun 12 may be a blind rivet hand tool, a hand riveter, a pneumatic riveter, a hydraulic rivet gun, or even a hand-held robotic riveter. The rivet gun 12 may also include an attachment port 18 formed therein, sized and shaped to facilitate attachment of one of the rivets 14. The attachment port 18 may be located in a head of the rivet gun 12 and may include an opening and/or temporary attachment features sized and may be configured to retain the rivet 14 in the rivet gun head before installing the rivet 14 into the structures to be joined, as described above.

The rivet dispenser 10, as illustrated in FIGS. 1-5, may be a unitary, single-piece tool and/or may comprise a tool body 20 and an attachment feature 22, such as a lanyard, attached to the tool body 20. For example, the tool body 20 may have a rivet-holding portion 24 and a handle portion 26, with a hole 28 formed through the handle portion 26 through which the lanyard may be threaded through or otherwise attached to. In other embodiments of the invention, the lanyard may attach to the handle portion 26 and/or rivet-holding portion 24 using any attachment methods known in the art. Additionally or alternatively, the lanyard may be integrally formed of one-piece construction with the tool body 20. The tool body 20 and/or the lanyard may be formed of metal, plastic, or any suitable material known in the art. The lanyard could be made of flexible and/or stretchable material. Portions of the tool body 20 may be made of a substantially rigid material, while other portions may be made with tolerances that allow a small amount of flexure suitable for selective retention of the rivets 14, as later described herein.

The handle portion 26 may have any shape and configuration and may be particularly sized and shaped to be ergonomically held by one hand of the user 16 or technician. As illustrated in FIGS. 2-5, the rivet-holding portion 24 may comprise two wall portions 30, 32 substantially parallel to each other, extending substantially laterally from the handle portion 26. The rivet-holding portion 24 may also comprise an inner beam 34 configured for maintaining the spacing between the two wall portions 30, 32. The inner beam 34 may extend from the handle portion 26 to an end of the wall portions 30, 32 opposite the handle portion 26, and may be centered between two opposing edges 36, 38 of each of the wall portions, as illustrated in FIGS. 2-5.

The two wall portions 30, 32 may comprise inner surfaces 40 and outer surfaces 42. The inner surfaces 40, which face each other, may each have channels 44 formed therein for retaining the heads of the rivets 14, as described above, and illustrated in FIGS. 4 and 5. In some embodiments of the invention, there may be two channels 44 formed into the inner surfaces 40 of each of the wall portions 30, 32, each formed along a portion or all of a length of the rivet-holding portion 24. For example, in the inner surface 40 of one of the wall portions 30, 32, there may be one channel at a location between the inner beam 34 and a left one of the side edges 36, and another channel at a location between the inner beam 34 and a right one of the side edges 38. The rivet-holding portion 24 may have a first end 46 through which the rivets 14 are inserted into the channels 44, and a second end 48, opposite the first end 46, at which the handle portion 26 meets the rivet-holding portion 24. Additionally or alternatively, an exit opening (not shown) or a wider gap between the two wall portions 30, 32 may be formed anywhere along a length of the rivet-holding portion 24, allowing an exit path for removing any of the rivets 14 from the rivet dispenser 10.

In use, the rivet dispenser 10 may individually dispense and load the rivets 14 into the rivet gun 12. Specifically, the user 16 may load the rivets 14 into the channels 44 of the rivet dispenser 10, grasping the rivet dispenser 10 in one hand, and then may grasp the rivet gun 12 in another hand. Next, the user 16 may move the rivet dispenser 10 and/or the rivet gun 12 toward each other such that one of the rivets 14 extending from the rivet dispenser 10 is inserted into the attachment port 18 of the rivet gun 12 and thus attached to the rivet gun 12 via the attachment port 18. Then the rivet dispenser 10 and/or the rivet gun 12 may be moved apart such that the rivet 14 attached to the rivet gun 12 is slid through and out of one of the channels 44 in which it was retrained. Once the rivet 14 is removed from the rivet dispenser 10, the user may install the rivet 14 into the desired work pieces or structures via one-handed actuation of the rivet gun 12.

Figure 6:
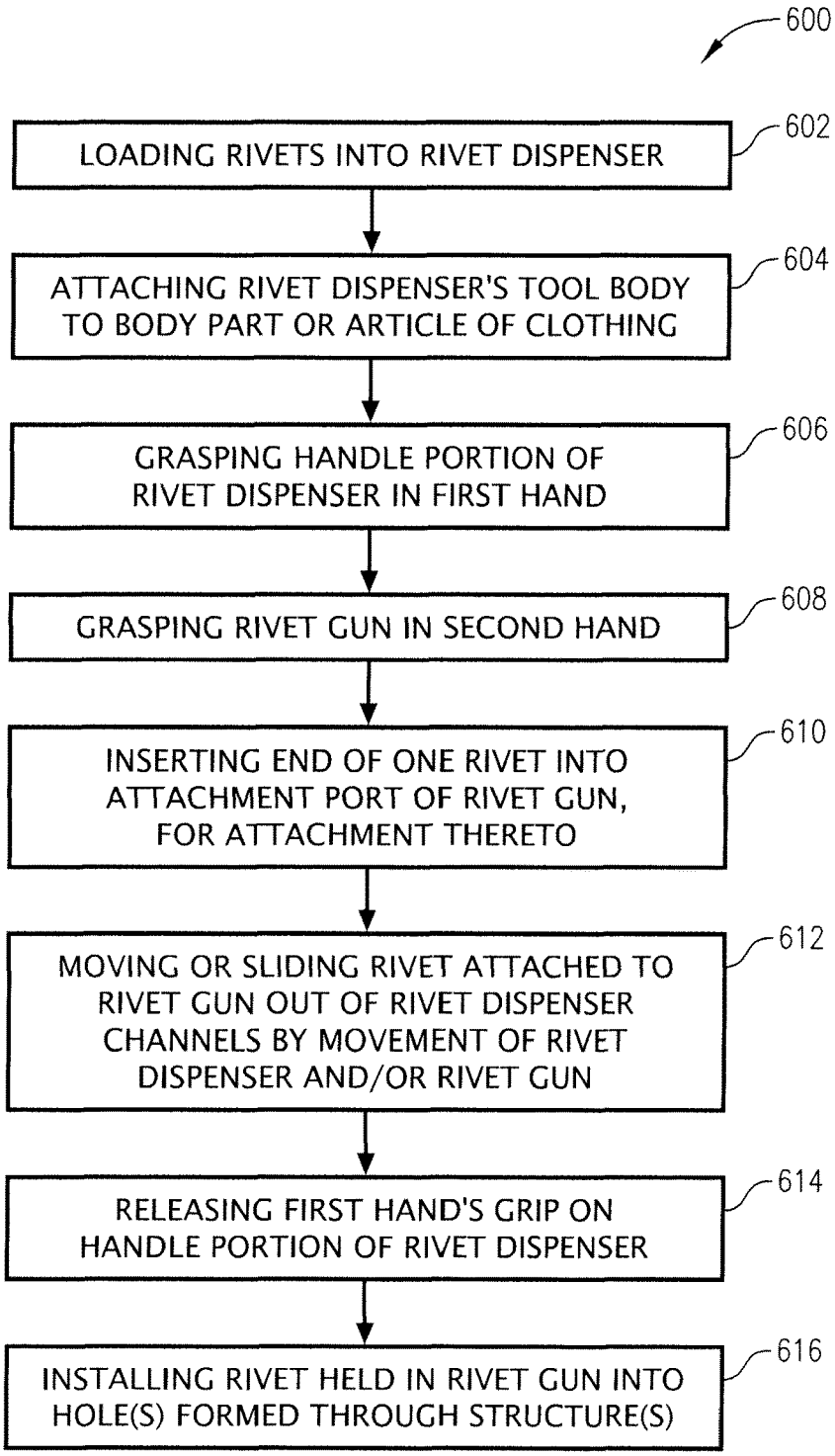
FIG. 6 is a flow chart illustrating a method of using the rivet dispenser to aid in manual installation of rivets onto the rivet gun in accordance with embodiments of the present invention.

Method steps for using the rivet dispenser 10 to aid in manual installation of rivets 14 onto the rivet gun 12 will now be described in more detail, in accordance with various embodiments of the present invention. The steps of the method 600 may be performed in the order as shown in FIG. 6, or they may be performed in a different order. Furthermore, some steps may be performed concurrently as opposed to sequentially. In addition, some steps may not be performed.

The method 600 may include a step of loading the rivets 14 into the rivet dispenser 10, as depicted in block 602. This may specifically include loading the rivets 14 into the rivet-holding portion 24 of the rivet dispenser 10 by sliding the rivet heads into the channels 44, in a lateral direction from the first end 46 to the second end 48 along a length of the rivet-holding portion 24. This can be done manually, or automated using any techniques known in the art for automated loading. The two wall portions 30, 32 of the rivet dispenser 10 may be flexible enough to flex slightly outward when the rivets 14 are slid into the channels 44 of the rivet dispenser 10, and yet rigid enough to retain the heads of the rivets 14 therebetween.

As illustrated in FIG. 1, the method 600 also may include a step of attaching the tool body 20 to a body part of the user 16 or an article of clothing of the user 16, as depicted in block 604, via the lanyard or any attachment device known in the art. For example, the lanyard may be threaded through the user's belt loop, buckle, or the like and threaded through the hole 28 formed through the handle portion 26 of the rivet dispenser 10.

The method 600 may further comprise the steps of grasping the handle portion 26 of the rivet dispenser 10 in a first hand 50, as depicted in block 606, grasping the rivet gun 12 in a second hand 52, as depicted in block 608 and illustrated in FIG. 1, and inserting an end of one rivet into the attachment port 18 of the rivet gun 12, as depicted in block 610. Specifically, the attachment port 18 may slide over an end or mandrel of one of the rivets 14 extending outward from the rivet-holding portion 24 of the rivet dispenser 10. The step 610 may be accomplished without releasing the user's grasp or grip on either the rivet dispenser 10 or the rivet gun 12. The user 16 may move the objects in each of the hands 50, 52 toward each other to properly align and insert the rivet 14 into the attachment port 18. Once pressed far enough into the attachment port 18, the rivet gun 12 may be attached to the rivet 14 automatically. In some alternative embodiments of the invention, the user 16 may be required to manipulate portions of the rivet gun 12 with the second hand 52 to trigger attachment of the rivet 14 or its mandrel to the rivet gun 12.

Then, the method 600 may include a step of moving the rivet 14 out of the rivet dispenser 12, as depicted in block 612. Specifically, this step may include sliding the rivet 14, now fixed to the rivet gun 12, out of one of one of the channels 44, via movement of the rivet gun 12 and/or the rivet dispenser 10. The rivet 14 may be slid laterally through the one of the channels 44 of the rivet-holding portion 24 until the rivet 14 is released from the rivet dispenser 10 at the first end 46 of the rivet-holding portion 24. Alternatively, the rivet 14 may slide to the exit opening or the wider gap between the two wall portions 30, 32, as described above, and may there be free to be pulled out of and away from the rivet dispenser 10.

Next, the method 600 may optionally include a step of releasing the first hand's grip on the handle portion 26 of the rivet dispenser 10, as depicted in block 614, such that the rivet dispenser 10 dangles from the lanyard or attachment feature 22. This may be useful, for example, if the user 16 needs to switch to a different sized insert for the attachment port 18 of the rivet gun 12. The user 16 can release the rivet dispenser 10 without worrying about dropping it or any of the rivets 14 disposed therein, and can then unscrew a different insert using a wrench, if necessary, to accommodate a mandrel or pin of the next type or size of rivet to be used.

Finally, the method 600 may include a step of installing the rivet 14 held in the rivet gun 12 into the hole or holes formed into one or more structures, as depicted in block 616. As described above, the holes of two or more structures may be aligned, with the structures positioned in a desired orientation for attachment. The holes may be sized and shaped for receiving the rivet 14 therein. For instance, the user 16 may squeeze a trigger or squeeze handles of the rivet gun 12 together one or more times until hearing a snapping sound indicating that the rivet 14 is attached to the structures. In some cases, the mandrel may remain in the rivet gun 12, but may be removed by pushing the mandrel through with another mandrel of the next rivet to be used.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method of manually loading a handheld rivet gun, the method comprising:

(a) grasping a rivet dispenser in a first hand, wherein the rivet dispenser comprises a unitary, single-piece tool body having at least one channel formed therein sized and shaped to retain heads of a plurality of rivets;

(b) grasping a handheld rivet gun in a second hand, wherein the handheld rivet gun includes an attachment port, wherein the rivet dispenser and rivet gun are independently movable relative to each other;

(c) inserting an end of one rivet, extending outward from the rivet dispenser, into the attachment port of the handheld rivet gun, thereby attaching the one rivet to the handheld rivet gun, (d) removing the one rivet such that only the one rivet of the plurality of rivets is moved relative to the rivet dispenser, via movement of at least one of the handheld rivet gun and the rivet dispenser, from the channel of the rivet dispenser; and (e) installing the one rivet into a hole formed into at least one structure using the handheld rivet gun, wherein the hole is sized and shaped for receiving the one rivet therein.

2. The method of claim 1, wherein rivet dispenser comprises a handle portion and a rivet-holding portion extending laterally from the handle portion.

3. The method of claim 2, wherein the rivet-holding portion comprises two wall portions substantially parallel with each other, wherein inner surfaces of the wall portions have the at least one channel formed therein, sized and shaped to retain a row of rivet heads.

4. The method of claim 3, further comprising the step of loading the plurality of rivets into the rivet-holding portion of the rivet dispenser by sliding the heads thereof into the at least one channel.

5. The method of claim 4, wherein the two wall portions are configured to flex slightly outward when the one rivet or the plurality of rivets are slid into the channels of the rivet dispenser.

6. The method of claim 1, further comprising a step of attaching the tool body to a body part or an article of clothing with a lanyard prior to the step of removing the one rivet.

7. The method of claim 6, further comprising a step of releasing the first hand's grip on the rivet dispenser after removing the one rivet via the handheld rivet gun, such that the rivet dispenser dangles from the lanyard.

8. The method of claim 1, wherein the handheld rivet gun is at least one of a hand riveter, a pneumatic riveter, a hydraulic rivet gun, and a hand-held robotic riveter small enough to be held and operated with the second hand.

9. A method of manually loading a handheld rivet gun, the method comprising:

(a) grasping a rivet dispenser in a first hand, wherein the rivet dispenser comprises a unitary, single-piece tool body having a handle portion and a rivet-holding portion extending laterally from the handle portion and having channels formed therein, each of the channels sized and shaped to retain heads of a plurality of rivets;

(b) grasping a handheld rivet gun in a second hand, wherein the handheld rivet gun includes an attachment port, wherein the rivet dispenser is unattached to the rivet gun and moves independent of the rivet gun;

(c) inserting an end of one rivet extending outward from the rivet-holding portion of the rivet dispenser, into the attachment port of the handheld rivet gun, thereby attaching the one rivet to the handheld rivet gun, (d) sliding the one rivet out of one of the channels such that only the one rivet of the plurality of rivets is moved relative to the rivet dispenser, via movement of at least one of the handheld rivet gun and the rivet dispenser, comprising sliding the one rivet through the one of the channels of the rivet-holding portion until the one rivet is released from the rivet dispenser at an end of the rivet-holding portion opposite the handle portion; and (e) installing the one rivet into a hole formed into at least one structure using the handheld rivet gun, wherein the hole is sized and shaped for receiving the one rivet therein.

10. The method of claim 9, wherein the rivet-holding portion comprises two wall portions substantially parallel with each other, wherein inner surfaces of the wall portions have the channels formed therein, sized and shaped to retain a row of rivet heads.

11. The method of claim 10, wherein the rivet-holding portion further comprises an inner beam centered between the two wall portions and sized to maintain proper spacing between the two wall portions sufficient to allow the heads of the plurality of rivets to fit in and be retained by the channels thereof.

12. The method of claim 10, wherein the two wall portions are configured to flex slightly outward when the one rivet or the plurality of rivets are slid into the channels of the rivet dispenser.

13. The method of claim 9, further comprising a step of attaching the tool body to a body part or an article of clothing with a lanyard prior to the step of sliding the one rivet.

14. The method of claim 13, further comprising a step of releasing the first hand's grip on the handle portion of the rivet dispenser after the step of sliding the one rivet out, such that the rivet dispenser dangles from the lanyard.

15. The method of claim 9, wherein the handheld rivet gun is at least one of a hand riveter, a pneumatic riveter, a hydraulic rivet gun, and a hand-held robotic riveter small enough to be held and operated with one hand.

16. The method of claim 9, further comprising the step of loading the plurality of rivets into the rivet-holding portion of the rivet dispenser by sliding the heads thereof into the channels.

17. A method of manually loading a handheld rivet gun, the method comprising:

(a) loading a plurality of rivets into a rivet dispenser, wherein the rivet dispenser comprises a unitary, single-piece tool body having a handle portion and a rivet-holding portion extending laterally from the handle portion and having channels formed therein, each of the channels sized and shaped to retain heads of a plurality of rivets;

(b) attaching the tool body to a body part or an article of clothing with a lanyard;

(c) grasping the handle portion of the rivet dispenser in a first hand;

(d) grasping a handheld rivet gun in a second hand, wherein the handheld rivet gun includes an attachment port, wherein the rivet dispenser is unattached to the rivet gun and moves independent of the rivet gun;

(e) moving the rivet dispenser toward the rivet gun, aligning and inserting an end of one rivet, extending outward from the rivet-holding portion of the rivet dispenser, into the attachment port of the handheld rivet gun, thereby attaching the one rivet to the handheld rivet gun, (f) sliding the one rivet out of one of the channels such that only the one rivet of the plurality of rivets is moved relative to the rivet dispenser, via movement of at least one of the handheld rivet gun and the rivet dispenser, comprising sliding the one rivet laterally through the one of the channels of the rivet-holding portion until the one rivet is released from the rivet dispenser at an end of the rivet-holding portion opposite the handle portion;

(g) releasing the first hand's grip on the handle portion of the rivet dispenser, such that the rivet dispenser dangles from the lanyard; and (h) installing the one rivet into a hole formed into at least one structure using the handheld rivet gun, wherein the hole is sized and shaped for receiving the one rivet therein.

18. The method of claim 17, wherein the rivet-holding portion comprises two wall portions substantially parallel with each other, wherein inner surfaces of the wall portions have the channels formed therein, sized and shaped to retain a row of rivet heads, wherein the rivet-holding portion further comprises an inner beam centered between the two wall portions and sized to maintain proper spacing between the two wall portions sufficient to allow the heads of the plurality of rivets to fit in and be retained by the channels thereof.

19. The method of claim 18, wherein the two wall portions are configured to flex slightly outward when the one rivet or the plurality of rivets are slid into the channels of the rivet dispenser.

20. The method of claim 17, wherein the handheld rivet gun is at least one of a hand riveter, a pneumatic riveter, a hydraulic rivet gun, and a hand-held robotic riveter small enough to be held and operated with one hand.

21. A method of manually loading a handheld rivet gun, the method comprising:

(a) loading a plurality of rivets into a rivet dispenser, wherein the rivet dispenser comprises a unitary, single-piece paddle-shaped tool body having a handle portion and a rivet-holding portion extending laterally from the handle portion, the rivet-holding portion comprising two wall portions substantially parallel with each other, inner surfaces of the wall portions having channels formed therein, each of the channels sized and shaped to retain heads of a plurality of rivets, the inner surfaces diverting away from each other near tops of the wall portions, the rivet-holding portion further comprising an inner beam centered between the two wall portions and sized to maintain proper spacing between the two wall portions sufficient to allow the heads of the plurality of rivets to fit in and be retained by the channels thereof, the two wall portions being configured to flex slightly outward when the plurality of rivets are slid into the channels;

(b) attaching the tool body to a body part or an article of clothing with a lanyard;

(c) grasping the handle portion of the rivet dispenser in a first hand;

(d) grasping a handheld rivet gun in a second hand, wherein the handheld rivet gun includes an attachment port, wherein the rivet dispenser is unattached to the rivet gun and moves independent of the rivet gun;

(e) moving the rivet dispenser toward the rivet gun, aligning and inserting an end of one rivet, extending outward from the rivet-holding portion of the rivet dispenser, into the attachment port of the handheld rivet gun, thereby attaching the one rivet to the handheld rivet gun, (f) sliding the one rivet out of one of the channels, via movement of at least one of the handheld rivet gun and the rivet dispenser, comprising sliding the one rivet laterally through the one of the channels of the rivet-holding portion until the one rivet is released from the rivet dispenser at an end of the rivet-holding portion opposite the handle portion;

(g) releasing the first hand's grip on the handle portion of the rivet dispenser, such that the rivet dispenser dangles from the lanyard; and (h) installing the one rivet into a hole formed into at least one structure using the handheld rivet gun, wherein the hole is sized and shaped for receiving the one rivet therein.

* * * * *